US009283797B2

(12) United States Patent
Tanaka et al.

(10) Patent No.: US 9,283,797 B2
(45) Date of Patent: Mar. 15, 2016

(54) SHEET PROCESSING APPARATUS AND IMAGE FORMING SYSTEM

(71) Applicants: Yusuke Tanaka, Kanagawa (JP); Atsushi Kuriyama, Kanagawa (JP); Makoto Seki, Kanagawa (JP); Yuta Kiyao, Kanagawa (JP)

(72) Inventors: Yusuke Tanaka, Kanagawa (JP); Atsushi Kuriyama, Kanagawa (JP); Makoto Seki, Kanagawa (JP); Yuta Kiyao, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/449,282

(22) Filed: Aug. 1, 2014

(65) Prior Publication Data

US 2015/0037119 A1 Feb. 5, 2015

(30) Foreign Application Priority Data

Aug. 2, 2013 (JP) ..... 2013-161372

(51) Int. Cl.

| | |
|---|---|
| ***B42B 5/00*** | (2006.01) |
| ***B65H 37/04*** | (2006.01) |
| ***B42F 3/00*** | (2006.01) |
| ***B65H 31/30*** | (2006.01) |

(Continued)

(52) U.S. Cl.

CPC ... *B42B 5/00* (2013.01); *B31F 5/02* (2013.01); *B42B 4/00* (2013.01); *B42C 1/12* (2013.01); *B42F 3/00* (2013.01); *B65H 31/3081* (2013.01); *B65H 37/04* (2013.01); *G03G 15/6544* (2013.01); *B65H 2301/51616* (2013.01); *B65H 2404/65* (2013.01); *B65H 2404/693* (2013.01); *G03G 2215/00852* (2013.01)

(58) Field of Classification Search

CPC ..... B42B 5/00; B31F 5/02; B42F 3/00; G03G 2215/00852; B65H 37/04; B65H 31/3081; B65H 2301/51616; B65H 2404/65; B65H 2404/693

USPC ..... 270/58.07, 58.08, 58.12, 58.17, 58.27; 412/33

See application file for complete search history.

(56) References Cited

U.S. PATENT DOCUMENTS 8,297,610 B2 * 10/2012 Shiraishi ..... 270/58.09
8,342,499 B2 1/2013 Shiraishi et al.

(Continued)

FOREIGN PATENT DOCUMENTS

JP 2004-167700 6/2004
JP 2004-250229 9/2004

(Continued)

OTHER PUBLICATIONS

U.S. Appl. No. 14/161,794, filed Jan. 23, 2014.

*Primary Examiner* — Leslie A Nicholson, III

(74) *Attorney, Agent, or Firm* — Harness, Dickey & Pierce, P.L.C.

(57) ABSTRACT

A sheet processing apparatus includes: a sheet conveying unit that conveys a sheet; a sheet stacking member on a placing surface of which the sheet conveyed by the sheet conveying unit is stacked; an edge aligning unit that aligns edges of sheets in a sheet conveying direction on the sheet stacking member; a first binding unit that binds the sheets aligned by the edge aligning unit using a binding member; and a second binding unit that binds the sheets aligned by the edge aligning unit without using a binding member. The sheet processing apparatus selects either of the first binding unit and the second binding unit and performs binding processing on the sheets. The first binding unit and the second binding unit are integrally constructed.

14 Claims, 10 Drawing Sheets

(51) Int. Cl.

| | |
|---|---|
| ***B31F 5/02*** | (2006.01) |
| ***B42B 4/00*** | (2006.01) |
| ***B42C 1/12*** | (2006.01) |
| ***G03G 15/00*** | (2006.01) |

(56) References Cited

U.S. PATENT DOCUMENTS

| | | | | |
|---|---|---|---|---|
| 8,444,133 | B2 * | 5/2013 | Kimura | 270/58.08 |
| 8,540,228 | B2 * | 9/2013 | Shiraishi | 270/58.09 |
| 2013/0264762 | A1 | 10/2013 | Matsushita et al. | |
| 2013/0300050 | A1 | 11/2013 | Suzuki et al. | |
| 2014/0138896 | A1 | 5/2014 | Yoshida et al. | |
| 2014/0151951 | A1 | 6/2014 | Shibasaki | |

FOREIGN PATENT DOCUMENTS

| | | |
|---|---|---|
| JP | 4044420 | 11/2007 |
| JP | 2011-207560 | 10/2011 |

* cited by examiner

SHEET PROCESSING APPARATUS AND IMAGE FORMING SYSTEM

CROSS-REFERENCE TO RELATED APPLICATION(S)

The present application claims priority to and incorporates by reference the entire contents of Japanese Patent Application No. 2013-161372 filed in Japan on Aug. 2, 2013.

BACKGROUND OF THE INVENTION

1. Field of the Invention

The present invention relates to a sheet processing apparatus that performs binding processing on sheets and an image forming system with the sheet processing apparatus.

2. Description of the Related Art

Conventionally, a sheet processing apparatus with a binding unit that performs binding processing on a sheet bundle including a plurality of sheets has been known, and an image forming system with the sheet processing apparatus has also been known.

For example, in a sheet processing apparatus only with a binding unit that binds a sheet bundle using a metal needle being a binding member, a binding failure may occur because a needle is too long when a sheet bundle including a small number of sheets is bound.

Moreover, in a sheet processing apparatus only with a binding unit such as crimp binding and half-extraction binding that binds a sheet bundle without using a metal needle, a binding failure may occur because a thick sheet bundle cannot be bound.

Japanese Laid-open Patent Publication No. 2011-207560 describes a sheet processing apparatus that includes a first binding unit that binds a sheet bundle using a metal needle and a second binding unit that is disposed in a position opposite to the first binding unit and binds a sheet bundle without using a metal needle.

As is the sheet processing apparatus described in Japanese Laid-open Patent Publication No. 2011-207560, a sheet processing apparatus that includes a plurality of binding units having different binding processing makes it possible to perform binding processing by using an optimal binding unit, thus preventing a binding failure.

However, in the sheet processing apparatus described in Japanese Laid-open Patent Publication No. 2011-207560, the first binding unit and the second binding unit are arranged at opposite positions, and this leads to a problem that the apparatus is upsized.

In view of the above, there is a need to provide a sheet processing apparatus capable of preventing a binding failure while suppressing upsizing of the apparatus and an image forming system with the sheet processing apparatus.

SUMMARY OF THE INVENTION

It is an object of the present invention to at least partially solve the problems in the conventional technology.

A sheet processing apparatus includes: a sheet conveying unit that conveys a sheet; a sheet stacking member on a placing surface of which the sheet conveyed by the sheet conveying unit is stacked; an edge aligning unit that aligns edges of sheets in a sheet conveying direction on the sheet stacking member; a first binding unit that binds the sheets aligned by the edge aligning unit using a binding member; and a second binding unit that binds the sheets aligned by the edge aligning unit without using a binding member. The sheet processing apparatus selects either of the first binding unit and the second binding unit and performs binding processing on the sheets. The first binding unit and the second binding unit are integrally constructed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 2:
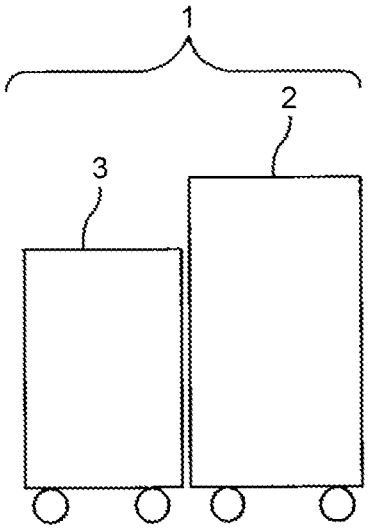
FIG. 2 is a schematic configuration diagram of an image forming system according to an embodiment.

FIG. 2 is a schematic configuration diagram of an image forming system according to an embodiment.

As illustrated in FIG. 2, an image forming system 1 includes an image forming device 2 and a sheet post-processing device 3 as a sheet processing apparatus.

The image forming device 2 and the sheet post-processing device 3 are communicably connected to each other. In the image forming system 1, after the image forming device 2 forms an image on a sheet, the sheet post-processing device 3 receives the sheet from the image forming device 2 and performs various types of post-processing on the received sheet.

Examples of the various types of post-processing include edge binding processing and center folding processing. The center folding processing includes saddle stitching processing. The sheet post-processing device 3 that performs these types of post-processing has an discharge mode, an edge binding mode, and a center folding mode as an operation mode.

Figure 3:
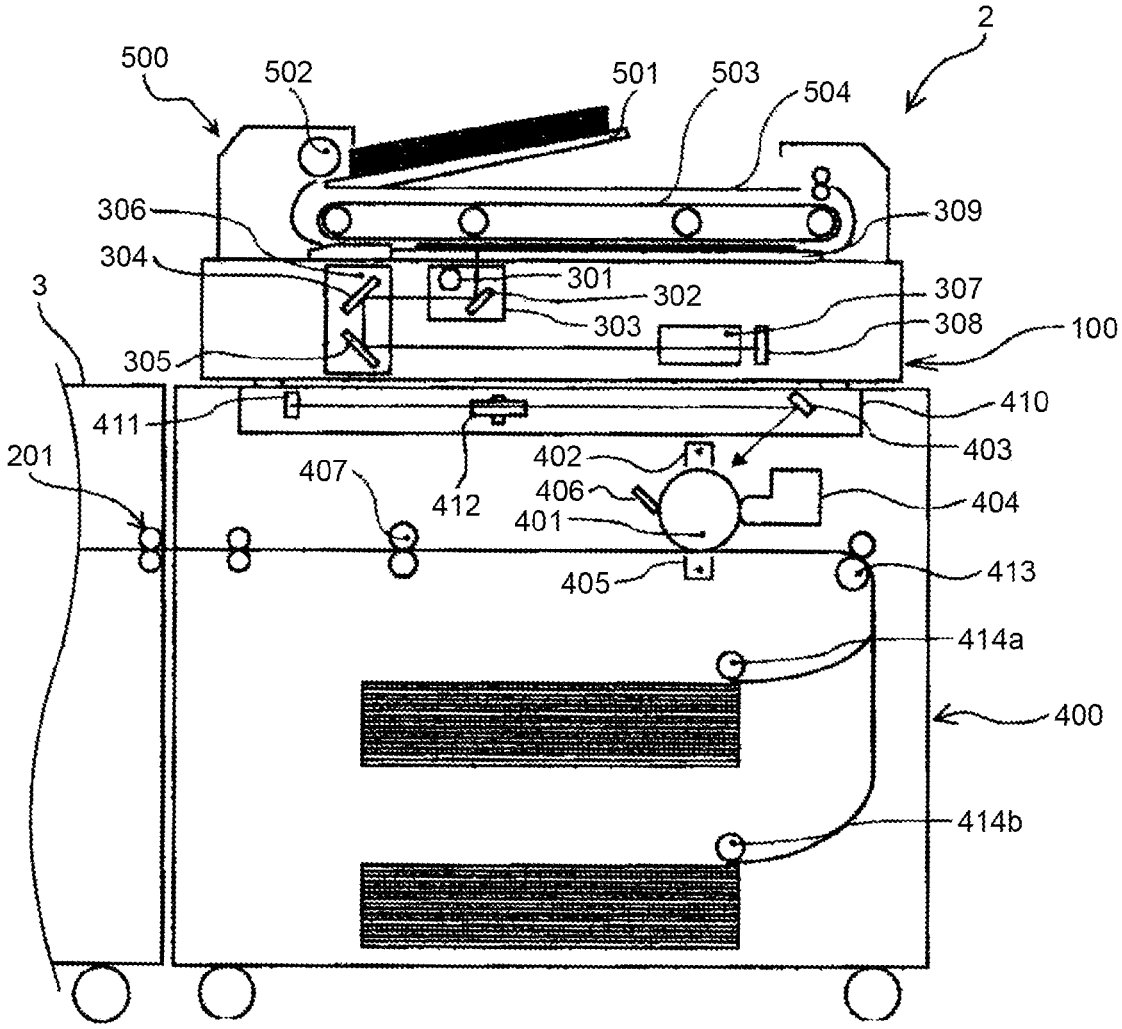
FIG. 3 is a diagram for explaining an image forming device.

FIG. 3 is a diagram for explaining the image forming device 2.

An image forming device body 400 has sheet feeding cassettes for storing sheets as recording media provided below an image forming unit. Each sheet stored in the sheet feeding cassettes is fed by either of sheet feeding rollers 414*a* and 414*b*, and is then conveyed upward along a predetermined conveying path to reach a registration roller pair 413.

The image forming unit includes a photosensitive drum 401 as an image carrier, a charging device 402, an exposure device 410, a developing device 404, a transfer device 405, and a cleaning device 406.

The charging device 402 is a charging unit that uniformly charges the surface of the photosensitive drum 401. The exposure device 410 is a latent image forming unit that forms an electrostatic latent image on the photosensitive drum 401 based on image information read by an image reading device 100. The developing device 404 is a developing unit that causes toner to adhere to the electrostatic latent image on the photosensitive drum 401 to obtain a visualized image. The transfer device 405 is a transfer unit that transfers a toner image on the photosensitive drum 401 to a sheet. The cleaning device 406 is a cleaning unit that removes toner remaining on the photosensitive drum 401 after the toner image is transferred.

A fixing device 407 as a fixing unit that fixes the toner image on the sheet is provided downstream of the image forming unit in a sheet conveying direction.

The exposure device 410 includes a laser unit 411 that emits a laser beam based on the image information under the control of a control unit (not illustrated), and a polygon mirror 412 that scans the laser beam emitted from the laser unit 411 in a direction of a rotating shaft of the photosensitive drum 401 (main scanning direction).

An automatic document feeder 500 is connected above the image reading device 100. The automatic document feeder 500 includes a document table 501, a document separation and feeding roller 502, a conveyor belt 503, and a document discharge tray 504.

The automatic document feeder 500 is configured such that, when documents are set on the document table 501 and a read start instruction is received, the documents on the document table 501 are fed one by one by the document separation and feeding roller 502. The document is guided onto a platen glass 309 by the conveyor belt 503 and is temporarily stopped.

Image information of the document temporarily stopped on the platen glass 309 is read by the image reading device 100. Thereafter, the document is again conveyed by the conveyor belt 503 and is discharged to the document discharge tray 504.

An image reading operation and an image forming operation will be explained next.

When a document is conveyed onto the platen glass 309 by the automatic document feeder 500 or a document is placed on the platen glass 309 by the user and when a copy start operation is input to an operation panel (not illustrated), a light source 301 on a first carriage 303 lights up. Along with this, the first carriage 303 and a second carriage 306 are moved along a guide rail (not illustrated).

The document on the platen glass 309 is irradiated with the light from the light source 301, and the light reflected thereby is guided by a mirror 302 on the first carriage 303, mirrors 304 and 305 on the second carriage 306, and by a lens 307, and is received by a charge-coupled device (CCD) 308. The CCD 308 thereby reads the image information from the document, and an analog-to-digital (A/D) conversion circuit (not illustrated) converts the read image information from analog data to digital data. The image information is transmitted from an information output unit (not illustrated) to the control unit of the image forming device body 400.

On the other hand, the image forming device body 400 starts driving the photosensitive drum 401, and causes the charging device 402 to uniformly charge the surface of the photosensitive drum 401 when the photosensitive drum 401 is rotated at a predetermined speed. The exposure device 410 then forms an electrostatic latent image on the surface of the charged photosensitive drum 401 based on the image information read by the image reading device.

Thereafter, the electrostatic latent image on the surface of the photosensitive drum 401 is developed by the developing device 404 to obtain a toner image. Each sheet stored in the sheet feeding cassettes is fed out by either of the sheet feeding rollers 414*a* and 414*b* and is temporarily stopped at the registration roller pair 413.

The sheet is fed into a transfer portion by the registration roller pair 413 to match the timing at which the leading edge of the toner image formed on the surface of the photosensitive drum 401 reaches the transfer portion that faces the transfer device 405. The toner image formed on the surface of the photosensitive drum 401 is transferred onto the sheet by the action of a transfer electric field when the sheet passes through the transfer portion.

Thereafter, the sheet with the toner image thereon is conveyed to the fixing device 407, is subjected to the fixing processing performed by the fixing device 407, and is discharged to the sheet post-processing device 3 provided at a subsequent stage. The residual toner after transfer that remains on the surface of the photosensitive drum 401 without being transferred to the sheet at the transfer portion is removed by the cleaning device 406.

Figure 4:
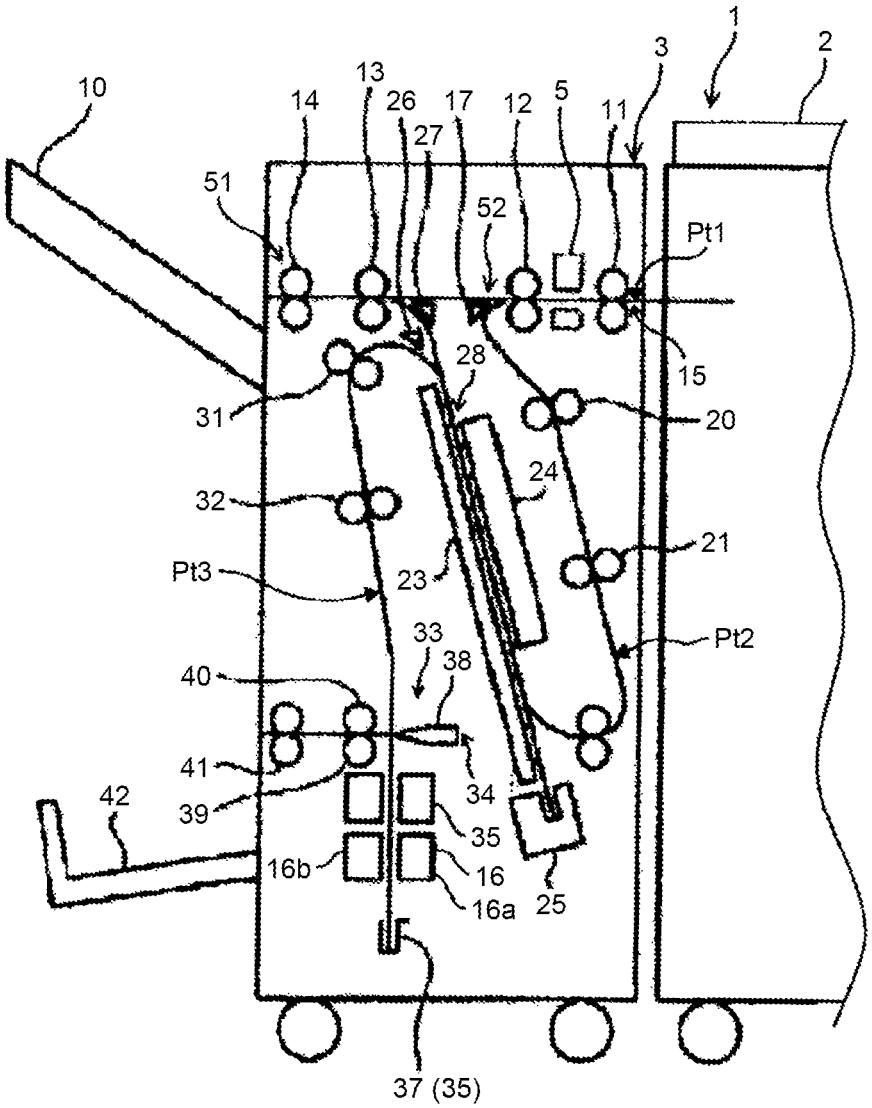
FIG. 4 is a diagram for explaining the sheet post-processing device.

FIG. 4 is a diagram for explaining the sheet post-processing device 3.

Provided in the sheet post-processing device 3 is a first conveying path Pt1 for receiving a sheet discharged from the image forming device 2 and discharging the sheet to a first sheet discharge tray 10. Provided also in the sheet post-processing device 3 are a second conveying path Pt2 that is branched from the first conveying path Pt1 and is for performing the edge binding processing or the like on the sheet bundle and a third conveying path Pt3 that is connected to the second conveying path Pt2 and is for performing the saddle stitching and center folding processing on the sheet bundle.

The first conveying path Pt1, the second conveying path Pt2, and the third conveying path Pt3 are formed by, for example, a guide member (not illustrated).

Arranged along the first conveying path Pt1 are an entrance roller 11, a conveying roller 12, a conveying roller 13, and a sheet discharge roller 14 in order from an upstream portion to a downstream portion of the first conveying path Pt1 in the sheet conveying direction.

The entrance roller 11, the conveying roller 12, the conveying roller 13, and the sheet discharge roller 14 are rotationally driven by a motor being a drive source to convey the sheet.

An entrance sensor 15 is disposed upstream of the entrance roller 11 in the sheet conveying direction. The entrance sensor 15 detects that the sheet is conveyed in the sheet post-processing device 3.

A bifurcating claw 17 is disposed downstream of the conveying roller 12 in the sheet conveying direction. The bifurcating claw 17 rotates and changes its position to selectively guide the sheet to either of a portion of the first conveying path Pt1 located downstream of the bifurcating claw 17 in the sheet conveying direction and the second conveying path Pt2. The bifurcating claw 17 is driven by, for example, a motor or a solenoid.

In the discharge mode, the sheet conveyed in the first conveying path Pt1 from the image forming device 2 is conveyed by the entrance roller 11, the conveying roller 12, the conveying roller 13, and the sheet discharge roller 14, and is discharged to the first sheet discharge tray 10.

On the other hand, in the edge binding mode and the center folding mode, the sheet conveyed in the first conveying path Pt1 is conveyed by the entrance roller 11 and the conveying roller 12, a feeding direction of the sheet is changed by the bifurcating claw 17, and the sheet is conveyed to the second conveying path Pt2.

Arranged along the second conveying path Pt2 are a conveying roller 20, a conveying roller 21, a conveying roller 22, a sheet stacking tray 23, a first sheet aligning unit 24, and an edge-binding processing unit (first binding processing unit) 25.

The conveying roller 20, the conveying roller 21, and the conveying roller 22 are motor driven to convey a sheet. The first sheet aligning unit 24 is motor driven.

A bifurcating claw 26 and a bifurcating claw 27 are arranged downstream of the sheet stacking tray 23 in the sheet conveying direction. The bifurcating claw 26 and the bifurcating claw 27 rotate and change their positions to selectively guide the sheet to either the portion of the first conveying path Pt1 located downstream of the bifurcating claw 17 in the sheet conveying direction or the third conveying path Pt3. The bifurcating claw 26 and the bifurcating claw 27 are driven by, for example, a motor or a solenoid.

In the edge binding mode, a sheet is sequentially stacked on the sheet stacking tray 23. A sheet bundle is thereby formed by stacking a plurality of sheets. At this time, the trailing edges of sheets abut on a first movable reference fence (not illustrated) provided in the sheet stacking tray 23, positions of the sheets in the sheet conveying direction are aligned, and positions of the sheets in their width direction are aligned by the first sheet aligning unit 24.

The sheet stacking tray 23, the first sheet aligning unit 24, and the first movable reference fence constitute a first bundling unit 28 as a bundling unit that stacks a plurality of sheets to form a sheet bundle. The first bundling unit 28 includes a motor for driving the first sheet aligning unit 24 and a motor for driving the first movable reference fence.

The sheet bundle bound at an edge is conveyed by the first movable reference fence to the first conveying path Pt1, and is thereafter conveyed by the conveying roller 13 and the sheet discharge roller 14 to be discharged to the first sheet discharge tray 10.

The sheet discharge roller 14 is an example of a sheet discharge unit that discharges a sheet bundle bound by the edge-binding processing unit 25. Meanwhile, in the center folding mode, the sheet conveyed to the second conveying path Pt2 is conveyed by the conveying roller 20, the conveying roller 21, the conveying roller 22, and the first movable reference fence to the third conveying path Pt3.

Arranged along the third conveying path Pt3 are a conveying roller 31, a conveying roller 32, and a saddle stitching and folding unit 33.

The conveying roller 31 and the conveying roller 32 are motor driven to convey a sheet. The saddle stitching and folding unit 33 includes a center folding unit 34, a saddle stitching processing unit (second binding processing unit) 35, and a second bundling unit 36.

The sheet conveyed to the third conveying path Pt3 is conveyed by the conveying roller 31 and the conveying roller 32 to be sequentially stacked on the second bundling unit 36. Thereby a plurality of sheets are stacked to form a sheet bundle. In other words, the second bundling unit 36 stacks the sheets conveyed by a conveying unit 51 to form a sheet bundle, the conveying unit 51 including the entrance roller 11, the conveying roller 12, the conveying roller 20, the conveying roller 21, the conveying roller 22, the conveying roller 31, and the conveying roller 32.

At this time, the leading edges of the sheets abut on a second movable reference fence 37, positions of the sheets in the sheet conveying direction are aligned, and positions of the sheets in their width direction are aligned by a second sheet aligning unit (not illustrated).

The sheet bundle is saddle-stitched by the saddle stitching processing unit 35 at a portion near the central portion of the sheet bundle in the sheet conveying direction. The saddle-stitched sheet bundle is returned to a center folding position by the second movable reference fence 37. The second movable reference fence 37 is motor driven.

The sheet bundle located at the center folding position is folded by the center folding unit 34 along the central portion in the sheet conveying direction. In the center folding unit 34, a folding blade 38 that faces the central portion of the sheet bundle located at the center folding position in the sheet conveying direction is moved from the right to the left in FIG. 2, and pushes the sheet bundle in between a lower pressing roller 39 and an upper pressing roller 40 while folding the central portion of the sheet bundle in the sheet conveying direction. The folding blade 38 is motor driven.

The folded sheet bundle is vertically pressed by the lower pressing roller 39 and the upper pressing roller 40. The lower pressing roller 39 and the upper pressing roller 40 are motor driven.

The sheet bundle folded in this way is discharged onto a second sheet discharge tray 42 by the lower pressing roller 39, the upper pressing roller 40, and a sheet discharge roller 41. The sheet discharge roller 41 is motor driven.

The entrance roller 11, the conveying roller 12, the conveying roller 13, the conveying roller 20, the conveying roller 21, the conveying roller 22, the conveying roller 31, the conveying roller 32, the sheet discharge roller 14, and the sheet discharge roller 41 constitute the conveying unit 51 together with the motors for driving these rollers.

The bifurcating claw 17, the bifurcating claw 26, and the bifurcating claw 27 constitute a path switching unit 52 together with the motors or the solenoids for driving the claws.

A characteristic portion of the sheet post-processing device 3 according to the present embodiment will be explained next.

Figure 1:
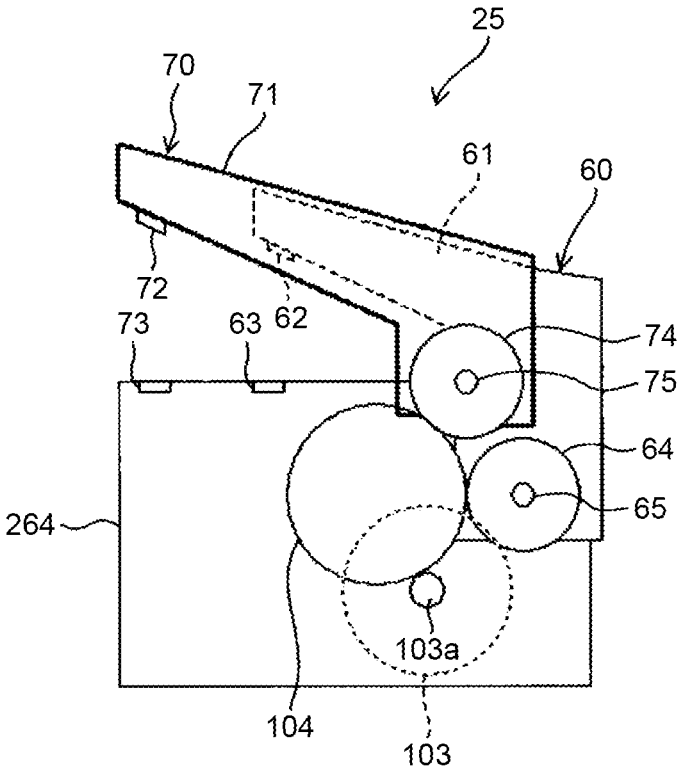
FIG. 1 is a side view of an edge-binding processing unit of a sheet post-processing device.
Figure 5:
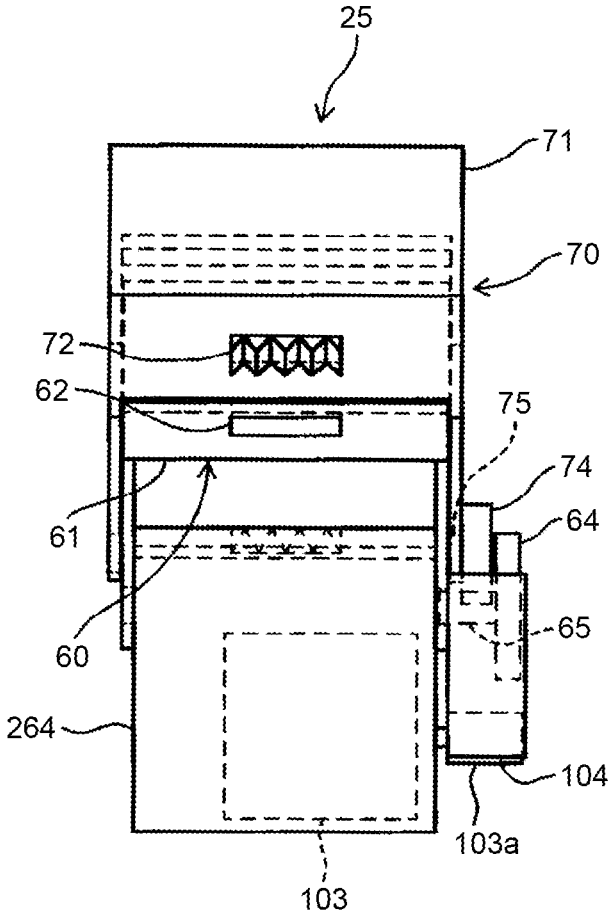
FIG. 5 is a front view of the edge-binding processing unit.
Figure 6:
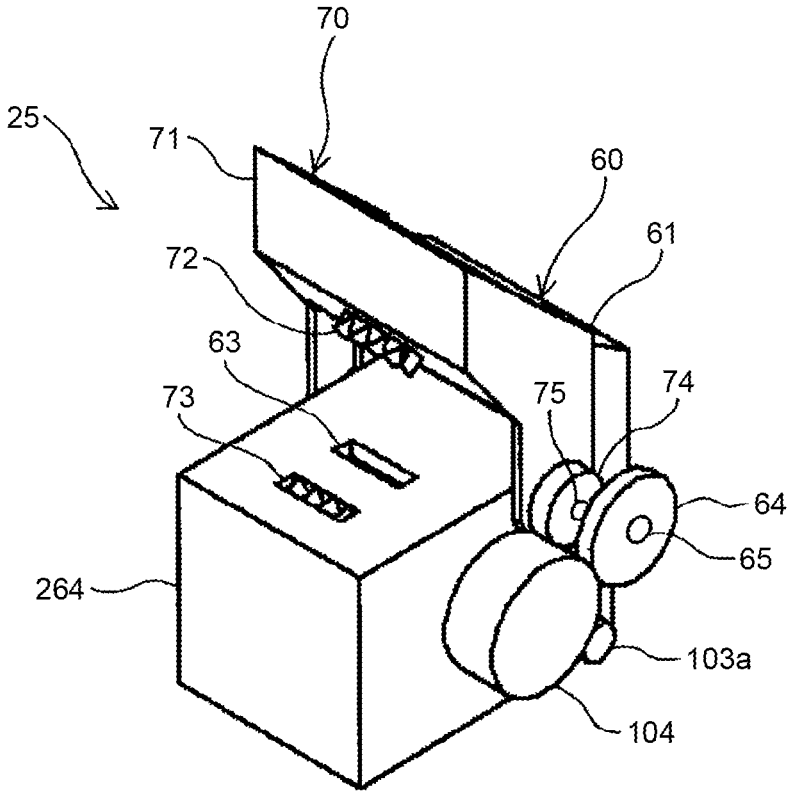
FIG. 6 is a front perspective view of the edge-binding processing unit.
Figure 7:
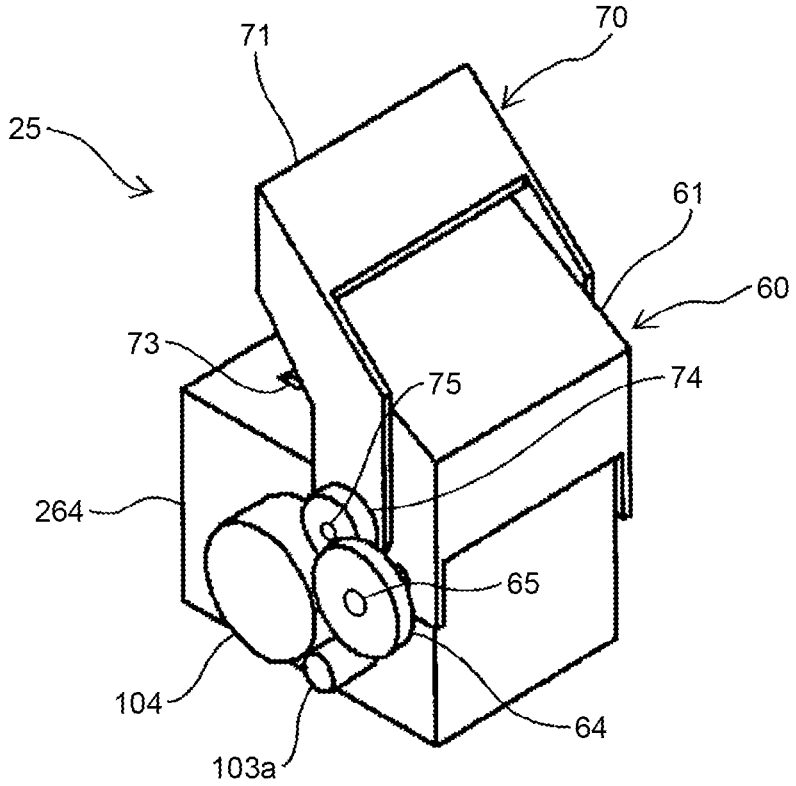
FIG. 7 is a rear perspective view of the edge-binding processing unit.

FIG. 1 is a side view of the edge-binding processing unit 25 of the sheet post-processing device 3. FIG. 5 is a front view of the edge-binding processing unit 25. FIG. 6 is a front perspective view of the edge-binding processing unit 25. FIG. 7 is a rear perspective view of the edge-binding processing unit 25.

The edge-binding processing unit 25 is integrally provided with a needle binding device 60 that binds a sheet bundle using a metal needle and with a crimp binding device 70 that is disposed at a position facing the needle binding device 60 and binds a sheet bundle by squeeze crimp-bonding without the metal needle.

In the needle binding device 60, a driver portion 63 that drives the metal needle and a clincher portion 62 that bends a tip of the metal needle driven into the sheet bundle are arranged to be a pair, so that the sheet bundle is bound by driving the metal needle into the sheet bundle and bending the tip of the metal needle penetrated from the sheet bundle.

The clincher portion 62 is provided at an end of an arm 61 rotatable around a rotating shaft 65. The driver portion 63 is provided in a housing 264 at a position facing the clincher portion 62.

The crimp binding device 70 uses a pair of crimp teeth that includes an upper tooth portion 72 and a lower tooth portion 73 each having an uneven surface to cramp the sheet bundle therewith, and thereby deforms the sheets and tangles their fibers to bind the sheet bundle.

The upper tooth portion 72 is provided at an end of an arm 71 rotatable around a rotating shaft 75. The lower tooth portion 73 is provided in the housing 264 at a position facing the upper tooth portion 72 so as not to protrude from the upper surface of the housing 264.

In the edge-binding processing unit 25, the arm 71 provided with the upper tooth portion 72 at its end is extended so as to overlap the arm 61 provided with the clincher portion 62 at its end, so that the needle binding device 60 and the crimp binding device 70 are arranged in alignment with each other in the edge-binding processing unit 25.

The arm 61 of the needle binding device 60 and the arm 71 of the crimp binding device 70 are rotated around the respective rotating shafts 65 and 75 by the drive force from a drive motor 103, and the binding operation is thereby performed.

A clutch 64 that is coaxially provided on the rotating shaft 65 of the arm 61 and propagates the drive and a clutch 74 that is coaxially provided on the rotating shaft 75 of the arm 71 and propagates the drive are engaged with a gear 104 that is engaged with a drive gear 103*a* of the drive motor 103.

In an ON state of the clutches 64 and 74, the clutches 64 and 74 are fixed to the rotating shafts 65 and 75 respectively, and when the clutches 64 and 74 are rotated, the rotating shafts are rotated in conjunction with them, and the arms 61 and 71 rotate about the rotating shafts 65 and 75 respectively.

On the other hand, in an OFF state of the clutches 64 and 74, the clutches 64 and 74 become capable of rotating relative to the rotating shafts 65 and 75 respectively and of idling, and thus the drive is not propagated to the arms 61 and 71 and the arms 61 and 71 are not therefore rotated.

When needle binding processing is to be performed, the binding processing is performed by setting the clutch 64 to the ON state, setting the clutch 74 to the OFF state, and driving the needle binding device 60 without driving the crimp binding device 70.

On the other hand, when crimp binding processing is to be performed, the binding processing is performed by setting the clutch 74 to the ON state, setting the clutch 64 to the OFF state, and driving the crimp binding device 70 without driving the needle binding device 60.

In the present embodiment, the needle binding device 60 and the crimp binding device 70 are integrally constructed as one unit and the unit is installed in the edge-binding processing unit 25. Therefore, the edge-binding processing unit 25 can be placed in a small space as compared with the case where the needle binding device 60 and the crimp binding device 70 are arranged opposite to each other.

The binding operations of the needle binding device 60 and the crimp binding device 70 are performed by the drive force from the drive motor being the same drive source. Therefore, space saving and cost reduction can be achieved as compared with the case where drive motors are separately provided in the needle binding device 60 and the crimp binding device 70.

Figure 8A:
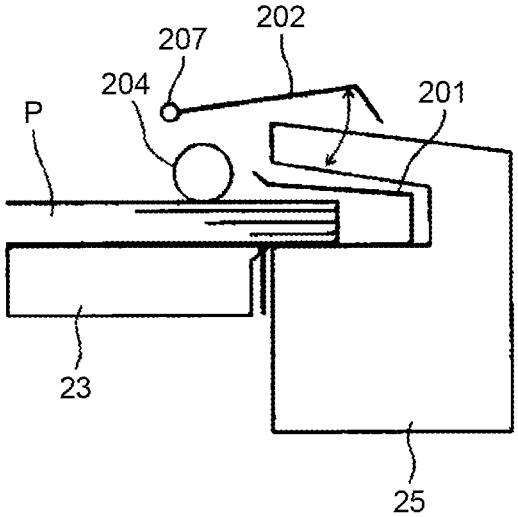
FIG. 8A and FIG. 8B are diagrams for explaining a first sheet-conveying-direction aligning member and a second sheet-conveying-direction aligning member.
Figure 8B:
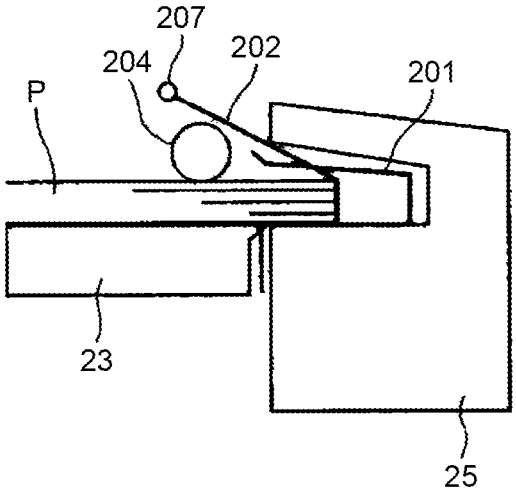

FIG. 8A and FIG. 8B are diagrams for explaining a first trailing-edge aligning member 201 and a second trailing-edge aligning member 202.

A sheet of paper P conveyed by a returning roller 204 abuts on an alignment face of the first trailing-edge aligning member 201, so that the trailing edges of the sheets are aligned.

The second trailing-edge aligning member 202 is held by a rotating shaft member 207 rotatably supported with respect to an apparatus body, and can be rotated in arrow directions of FIG. 8A.

In the present embodiment, when the needle binding device 60 performs the binding processing, the trailing edges of the sheets are aligned by the first trailing-edge aligning member 201, while when the crimp binding device 70 performs the binding processing, the trailing edges of the sheets are aligned by the second trailing-edge aligning member 202.

When the trailing edges of the sheets are aligned by the first trailing-edge aligning member 201, the second trailing-edge aligning member 202 is retracted to a retracted position where the second trailing-edge aligning member 202 is located in FIG. 8A so as not to come into contact with the sheet P and the edge-binding processing unit 25. The sheet P is fed toward the first trailing-edge aligning member 201 by the returning roller 204, the trailing edges of the sheets are made to abut on the alignment face of the first trailing-edge aligning member 201, and the trailing edges of the sheets are thereby aligned.

On the other hand, when the trailing edges of the sheets are aligned by the second trailing-edge aligning member 202, the second trailing-edge aligning member 202 is lowered to an alignment position where the second trailing-edge aligning member 202 is located in FIG. 8B. The sheet P is fed toward the first trailing-edge aligning member 201 by the returning roller 204, the trailing edges of the sheets are made to abut on the alignment face of the second trailing-edge aligning member 202, and the trailing edges of the sheets are thereby aligned.

When the edge-binding processing unit 25 is moved in the width direction of the sheet, the second trailing-edge aligning member 202 is previously retracted to a position where it does not interfere with the edge-binding processing unit 25.

In this way, in the present embodiment, the alignment positions of the trailing edges of the sheets are made different in the sheet conveying direction depending on whether the binding processing is performed by the needle binding device 60 or the binding processing is performed by the crimp binding device 70. Thereby the binding position of the sheets from the trailing edges of the sheets become constant even if either of the needle binding device 60 and the crimp binding device 70 is used to perform the binding processing. Therefore, a binding mark can be prevented from overlapping with an image portion of the sheet.

Figure 9A:
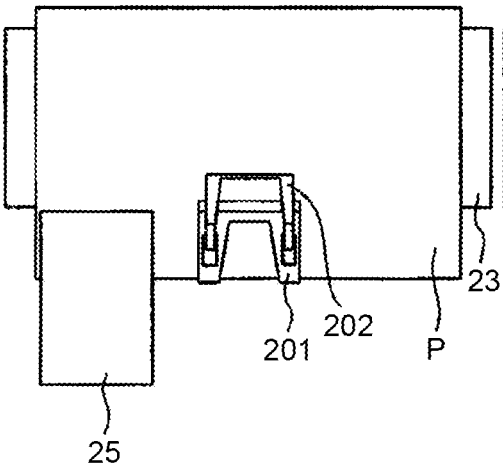
FIG. 9A and FIG. 9B are diagrams of the first sheet-conveying-direction aligning member and the second sheet-conveying-direction aligning member viewed from above.
Figure 9B:
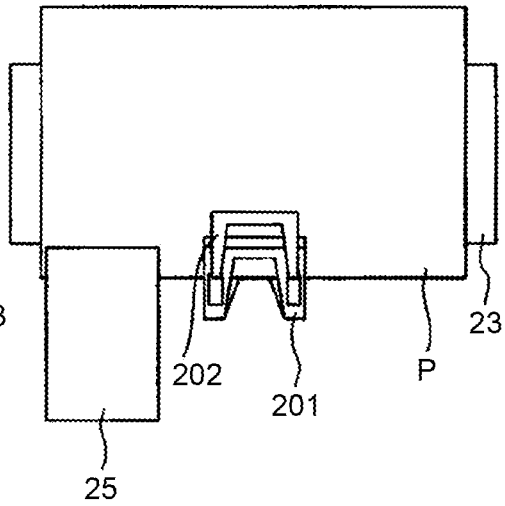

FIG. 9A and FIG. 9B are diagrams of the first trailing-edge aligning member 201 and the second trailing-edge aligning member 202 viewed from above.

As illustrated in FIG. 9A, the second trailing-edge aligning member 202 is arranged right above the first trailing-edge aligning member 201. When the second trailing-edge aligning member 202 is lowered, as illustrated in FIG. 9B, the edges of the second trailing-edge aligning member 202 enter cutouts formed in the first trailing-edge aligning member 201. Thereby the first trailing-edge aligning member 201 and the second trailing-edge aligning member 202 are configured not to interfere with each other.

Figure 10A:
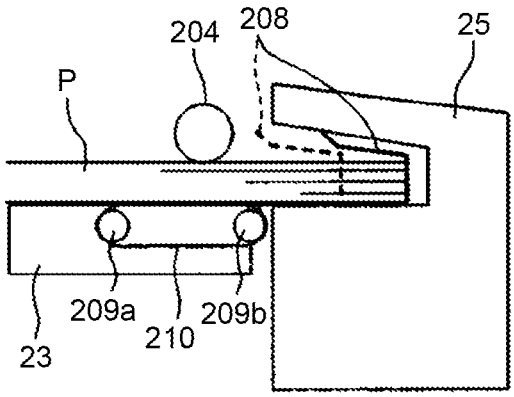
FIG. 10A and FIG. 10B are diagrams of another configuration of the trailing-edge aligning member for aligning the trailing edges of sheets to be bound by the edge-binding processing unit.
Figure 10B:
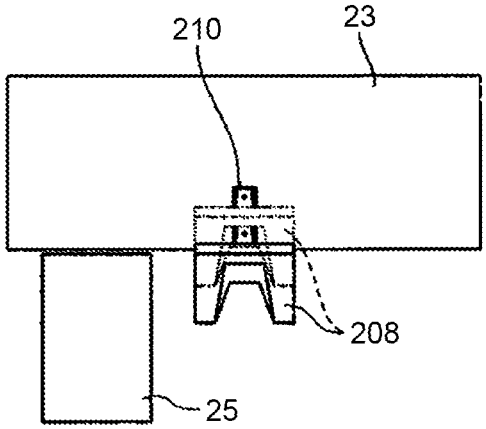

FIG. 10A and FIG. 10B are diagrams of another configuration of the trailing-edge aligning member for aligning the trailing edges of sheets to be bound by the edge-binding processing unit 25.

A trailing-edge aligning member 208 is provided on the upper surface of a belt 210 rotatably stretched by a pulley 209*a* and a pulley 209*b*. Either of the pulley 209*a* and the pulley 209*b* is rotationally driven by the drive force from the motor being the drive source (not illustrated), and, in association with the rotation of the belt 210 rotated thereby, the trailing-edge aligning member 208 can be moved in the sheet conveying direction.

Alignment positions, where the trailing-edge aligning member 208 is located when the trailing edges of the sheets are made to abut on the alignment face of the trailing-edge aligning member 208 to align the trailing edges of the sheets, differ between the binding processing performed by the needle binding device 60 and the binding processing performed by the crimp binding device 70.

More specifically, as illustrated in FIG. 10A and FIG. 10B, the alignment position in the binding processing performed by the needle binding device 60 is a position of the trailing-edge aligning member 208 indicated by solid line, and the alignment position in the binding processing performed by the crimp binding device 70 is a position of the trailing-edge aligning member 208 indicated by broken line.

Therefore, the trailing-edge aligning member 208 is moved to either of the alignment positions preset for the binding processing performed by the needle binding device 60 and for the binding processing performed by the crimp binding device 70 according to a selection of the binding methods, and waits for incoming sheets.

Figure 11:
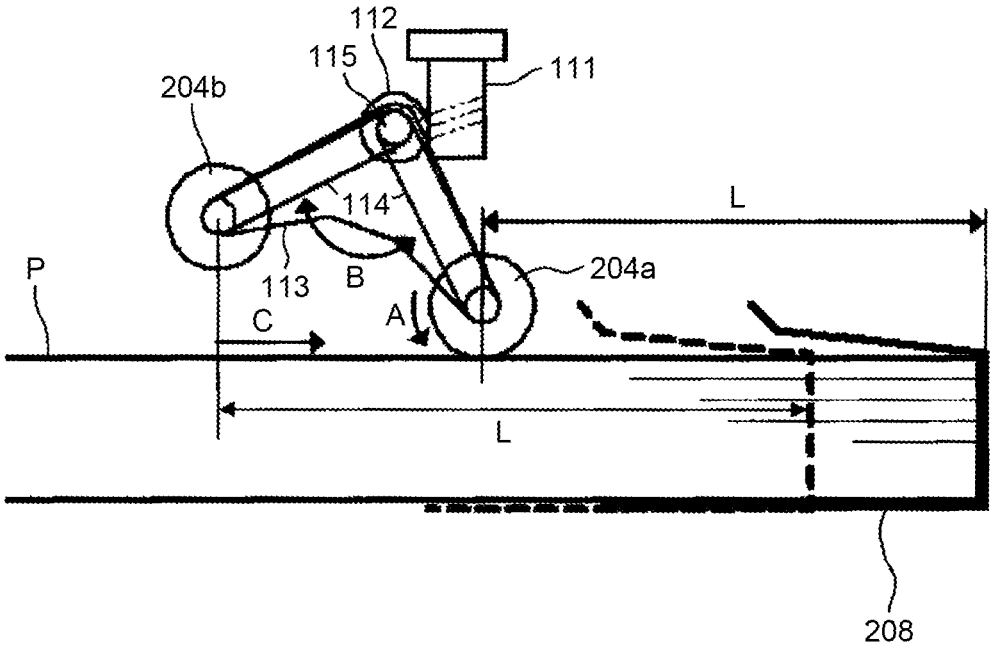
FIG. 11 is a diagram for explaining an entire configuration of a unit for swinging returning rollers according to an alignment position where the trailing-edge aligning member is located.

As illustrated in FIG. 11, a configuration to separately use two returning rollers 204*a* and 204*b* can be adopted, positions of the returning rollers 204*a* and 204*b* being different in the sheet conveying direction depending on the alignment positions where the trailing-edge aligning member 208 is located.

Each of the returning rollers 204*a* and 204*b* comes in contact with the sheet and rotates in the direction of arrow A in the figure to feed the sheet in the direction of arrow C in the figure, and cause the trailing edge of the sheet to abut on the alignment face of the trailing-edge aligning member 208.

The alignment positions where the trailing-edge aligning member 208 is located for aligning the trailing edges of the sheets differ between the binding processing performed by the needle binding device 60 and the binding processing performed by the crimp binding device 70. Therefore, the returning roller 204*a* and the returning roller 204*b* are provided at different positions in the sheet conveying direction in a returning roller holding plate 113 that is swingable around a rotating shaft 115.

Then, a positional relation between each of positions where the returning rollers 204*a* and 204*b* are in contact with a sheet and an alignment position of the trailing-edge aligning member 208 is configured to become the same as each other even in the binding processing performed by either binding device of the needle binding device 60 and the crimp binding device 70.

Because the position of the clincher of the needle binding device 60 is different from the position of the crimp teeth of the crimp binding device 70 in the sheet conveying direction, the trailing-edge aligning member 208 is located at either of the two alignment positions according to the respective binding units to align the trailing edges of the sheets. Therefore, the returning roller holding plate 113 is swung in the direction of arrow B in FIG. 11 so that a distance L between the alignment face of the trailing-edge aligning member 208 and each of the returning rollers 204*a* and 204*b* in the sheet conveying direction is, that is, a relation between the alignment positions different from each other depending on the binding positions is maintained constant. When the binding processing is performed by the needle binding device 60, then the returning roller 204*a* is brought into contact with the sheet P, while when the binding processing is performed by the crimp binding device 70, then the returning roller 204*b* is brought into contact with the sheet P.

In this way, the positional relation between the alignment face of the trailing-edge aligning member 208 and each of the returning rollers 204*a* and 204*b* is maintained constant regardless of the binding devices, which makes it possible to improve alignment accuracy of the trailing edges of the sheets.

Figure 12:
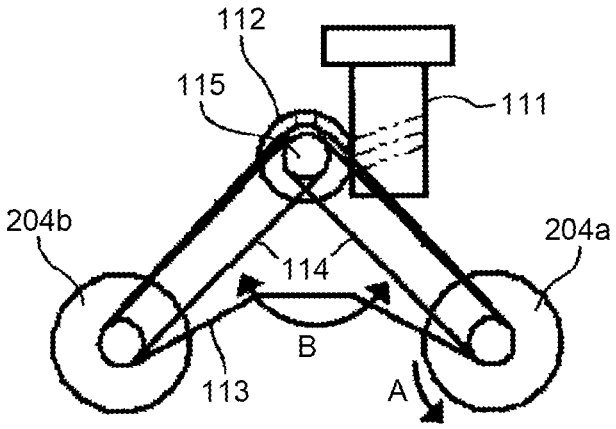
FIG. 12 is a diagram for explaining a swing mechanism of the returning rollers.

A swing mechanism of the returning rollers 204*a* and 204*b* will be explained below with reference to FIG. 12, FIG. 13, and FIG. 14.

The returning rollers 204*a* and 204*b* are configured to rotate through timing belts 114*a* and 114*b*, respectively. The returning rollers 204*a* and 204*b* are fixed by the returning roller holding plate 113 for holding the returning rollers 204*a* and 204*b* so as to be separated from each other.

A worm wheel 112 is held so as to be integrated with the returning roller holding plate 113 or so that its rotation is synchronized with the returning roller holding plate 113. The worm wheel 112 is rotated by the drive force transmitting from the drive source (not illustrated) thereto via a worm gear 111. Side faces 113*a* and 113*b* of the returning roller holding plate 113 is push by a claw-shaped portion 112*a* erected on a side face of the worm wheel 112 due to the rotation of the worm wheel 112, so that the returning roller holding plate 113 is rotated around the rotating shaft in the directions of arrow B in the figure. The returning rollers 204*a* and 204*b* are also swung in the directions of arrow B in the figure in conjunction with the rotation.

The returning roller holding plate 113 and the worm wheel 112 are provided to be capable of being rotated by the same rotating shaft 115. The rotating shaft 115 is provided with a pulley (not illustrated) to stretch the timing belts 114*a* and 114*b* and to transmit the drive force.

The worm wheel 112 is pivotally supported on the rotating shaft 115 via a bearing (not illustrated) so that the drive thereof is not propagated to the worm wheel 112, and the drive of a shaft as the drive source of the timing belts 114*a* and 114*b* is thereby separated from the drive of the worm wheel 112.

Figure 13:
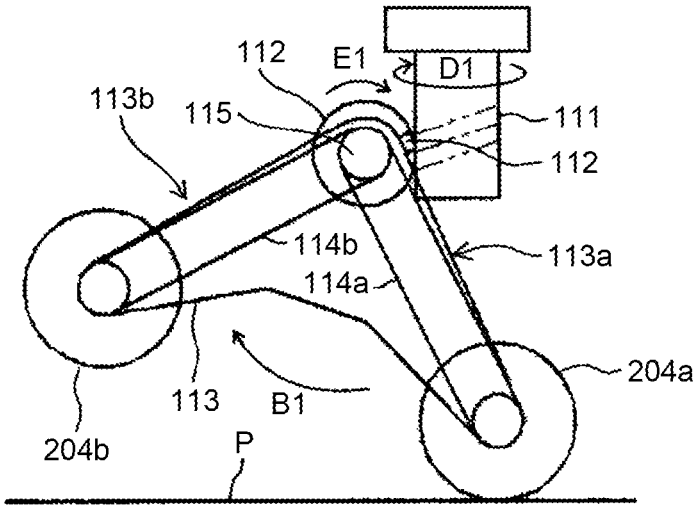
FIG. 13 is a diagram for explaining the swing mechanism of the returning rollers.

When the returning roller 204*a* is brought into contact with the sheet P, as illustrated in FIG. 13, the worm gear 111 is rotated in the direction of arrow D1 in the figure. This causes the worm wheel 112 to rotate in the direction of arrow E1 in the figure (clockwise in the figure), and a side face 113*a* of the returning roller holding plate 113 closer to the returning roller 204*a* is pushed by the claw-shaped portion 112*a* erected on the side face of the worm wheel 112. Thereby the returning roller holding plate 113 is rotated in the direction of arrow B1 in the figure (clockwise in the figure) about the rotating shaft 115, and the returning roller 204*a* lowers to come in contact with the sheet P.

Figure 14:
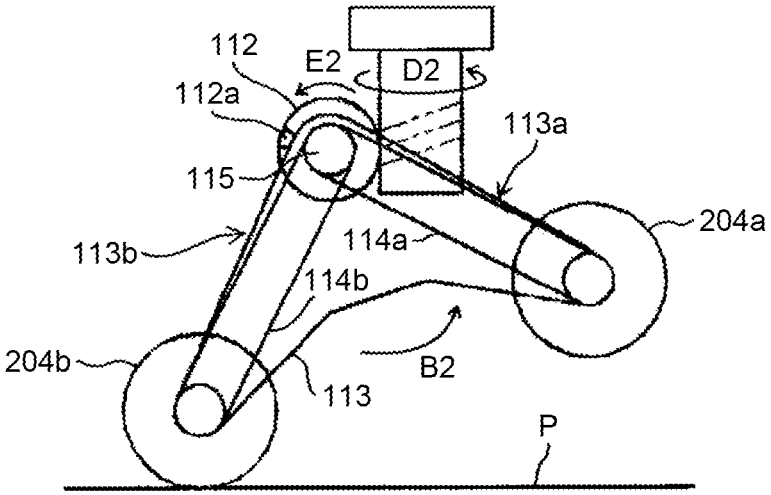
FIG. 14 is a diagram for explaining the swing mechanism of the returning rollers.

On the other hand, when the returning roller 204*b* is brought into contact with the sheet P, as illustrated in FIG. 14, the worm gear 111 is rotated in the direction of arrow D2 in the figure. This causes the worm wheel 112 to rotate in the direction of arrow E2 in the figure (counterclockwise in the figure), and a side face 113*b* of the returning roller holding plate 113 closer to the returning roller 204*b* is pushed by the claw-shaped portion 112*a* erected on the side face of the worm wheel 112. Thereby the returning roller holding plate 113 is rotated in the direction of arrow B2 in the figure (counterclockwise in the figure) about the rotating shaft 115, and the returning roller 204*b* lowers to come in contact with the sheet P.

Figure 15:
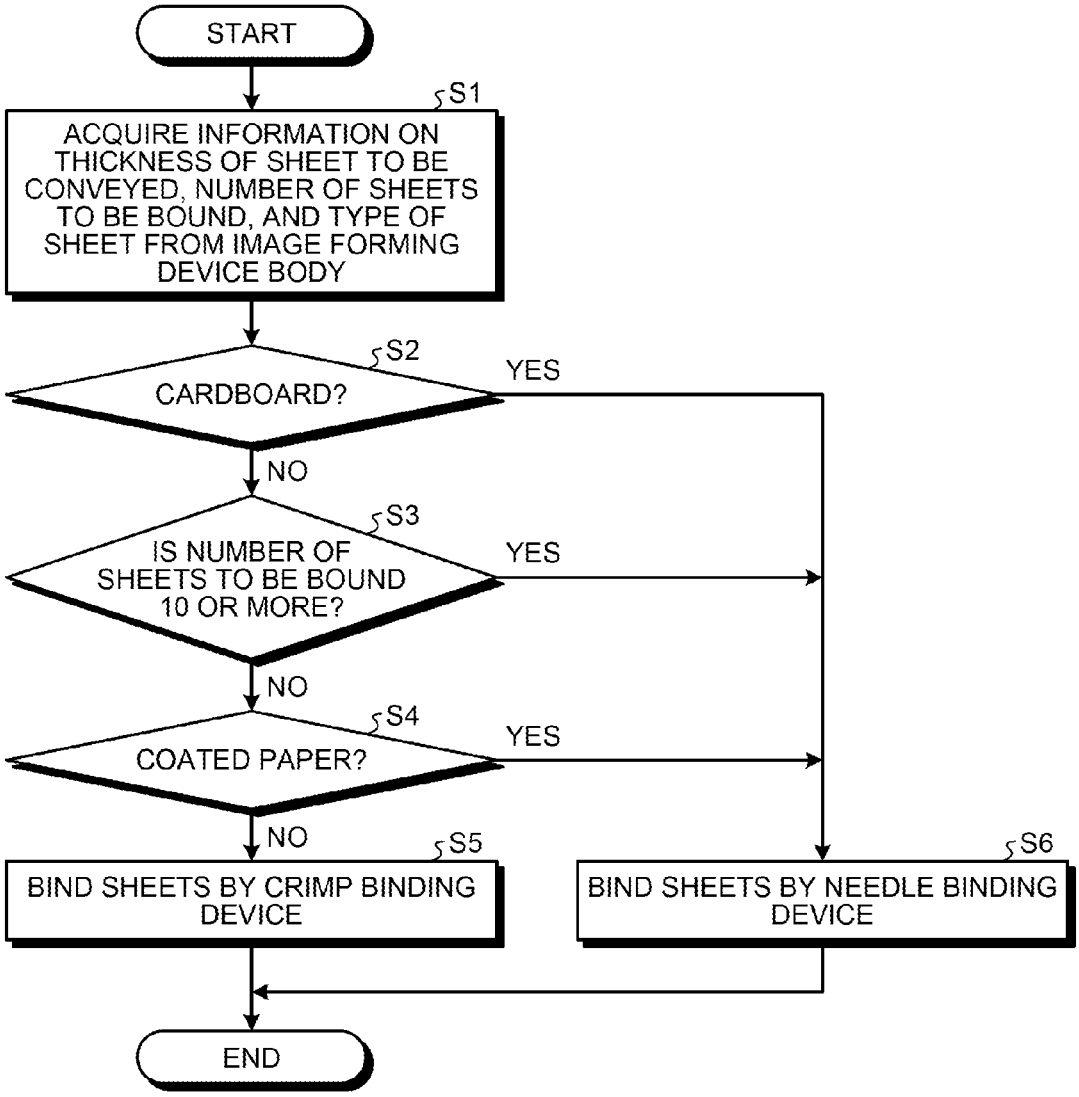
FIG. 15 is a flowchart of an example of controlling edge binding processing in the sheet post-processing device.

FIG. 15 is a flowchart of an example of controlling the edge binding processing in the sheet post-processing device 3 according to the present embodiment.

When the edge binding processing is to be performed, first of all, information on sheets to be processed by the sheet post-processing device 3 (thickness of the sheets, number of sheets to be bound, and type of the sheets) is acquired from the image forming device 2 (S1).

Subsequently, it is determined whether the sheet subjected to the edge binding processing is cardboard from the acquired sheet information (S2). When the sheet is cardboard (YES at S2), then it is difficult for the crimp binding device 70 to bind the sheets, and therefore the needle binding device 60 performs the edge binding processing on the sheets (S6), and a series of controls are completed.

Meanwhile, when the sheet is not cardboard (NO at S2), it is determined whether the number of sheets to be bound (the number of sheets that form a sheet bundle) is 10 or more (S3). When it is 10 or more (YES at S3), then it is difficult for the crimp binding device 70 to bind the sheets, and therefore the needle binding device 60 performs the edge binding processing on the sheets (S6), and a series of controls are completed.

When the number of sheets to be bound is less than 10 (NO at S3), it is determined whether the type of sheet is coated paper (S4). When it is coated paper (YES at S4), the surface of the sheet has a coat layer and a sheet fiber portion is small, and it is therefore difficult to bind the sheets by crimp binding that is performed by tangling sheet fibers. Therefore, the needle binding device 60 performs the edge binding processing on the sheets (S6), and a series of controls are completed.

Meanwhile, when it is not coated paper (NO at S4), then the crimp binding device 70 performs the edge binding processing on the sheets (S5), and a series of controls are completed.

The explanation as above is only an example, and the present invention has a specific effect in each of the following aspects.

Aspect A

In a sheet processing apparatus such as the sheet post-processing device 3 including a sheet conveying unit such as the conveying roller 22 that conveys a sheet, a sheet stacking member such as the sheet stacking tray 23 on a placing surface of which the sheet conveyed by the sheet conveying unit is stacked, an edge aligning unit such as the trailing-edge aligning member 208 that aligns edges of sheets in a sheet conveying direction on the sheet stacking member, a first binding unit such as the needle binding device 60 that binds the sheets aligned by the edge aligning unit using a binding member such as a metal needle, and a second binding unit such as the crimp binding device 70 that binds the sheets aligned by the edge aligning unit without using the binding member, and selecting either of the first binding unit and the second binding unit and performs binding processing on the sheets, the first binding unit and the second binding unit are integrally constructed.

In the aspect A, by integrally configuring the first binding unit and the second binding unit, an installation space can be made smaller than a case in which the first binding unit and the second binding unit are arranged opposite to each other, which makes it possible to suppress upsizing of the apparatus accordingly. Therefore, it is possible to prevent a binding failure while suppressing the upsizing of the apparatus even if a plurality of binding units such as the first binding unit and the second binding unit are provided.

Aspect B

In the aspect A, a binding position of the sheets by the first binding unit and a binding position of the sheets by the second binding unit are set so as to be arrayed in the sheet conveying direction on the sheet stacking member, and an alignment position where the edge aligning unit aligns the edges in the sheet conveying direction on the sheet stacking member is changed in the sheet conveying direction depending on whether for the first binding unit or the second binding unit. According to this configuration, as explained in the embodiment, the position where the sheets are bound can be made constant even if the binding processing is performed by either of the first binding unit and the second binding unit.

Aspect C

In the aspect B, the edge aligning unit can be moved in the sheet conveying direction, and moves the sheets aligned by the edge aligning unit up to the alignment position corresponding to the first binding unit or to the second binding unit. According to this configuration, as explained in the embodiment, the position where the sheets are bound can be made constant with a simple configuration.

Aspect D

In the aspect B or the aspect C, the sheet processing apparatus further includes a sheet feeding unit that comes in contact with the sheet conveyed on the sheet stacking member at a position apart from the edge aligning unit by a predetermined distance in the sheet conveying direction and that feeds the sheet toward the edge aligning unit, and a sheet-contact-position changing unit that changes a sheet contact position at which the sheet feeding unit contacts the sheet, in the sheet conveying direction. The sheet contact position is changed by the sheet-contact-position changing unit according to the alignment position corresponding to the first binding unit or to the second binding unit. According to this configuration, as explained in the embodiment, a positional relation between the edge aligning unit and the sheet feeding unit is maintained, thus stabilizing the alignment accuracy of the sheets.

Aspect E

In the aspect A, the aspect B, the aspect C, or in the aspect D, the first binding unit or the second binding unit is selected based on the information on the sheets to perform the binding processing on the sheets. According to this configuration, as explained in the embodiment, an appropriate binding unit can be selected, thus preventing a binding failure, a binding jam, or the like.

Aspect F

An image forming system such as an image forming system 1 includes an image forming device such as the image forming device 2 that forms an image on a sheet, and a sheet processing apparatus such as the sheet post-processing device 3 that performs at least binding processing on a bundle of sheets on which images are formed by the image forming device. The sheet processing apparatus according to any one of the aspect A, the aspect B, the aspect C, the aspect D, or the aspect E is used as the sheet processing apparatus. According to this configuration, as explained in the embodiment, it is possible to prevent a binding failure of the sheets on which images are formed while suppressing the upsizing of the image forming system.

An embodiment provides an excellent advantageous effect that the binding failure can be prevented while suppressing the upsizing of the apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a sheet conveying unit to convey a sheet;

a sheet stacking member on a placing surface of which the sheet to be conveyed by the sheet conveying unit is stackable with other sheets;

an edge aligning unit to align edges of the sheets in a sheet conveying direction on the sheet stacking member;

a first binding unit to bind the sheets aligned by the edge aligning unit using a binding member;

a second binding unit to bind the sheets aligned by the edge aligning unit without using the binding member, either of the first binding unit and the second binding unit performs binding of the sheets when selected, wherein an alignment position in the sheet conveying direction, where the edge aligning unit is configured to align the edges in the sheet conveying direction on the sheet stacking member, corresponding to the first binding unit is different from an alignment position corresponding to the second binding unit;

a sheet feeding unit, configured to come in contact with the sheet conveyed on the sheet stacking member at a position apart from the edge aligning unit by a distance in the sheet conveying direction, to feed the sheet toward the edge aligning unit; and a sheet-contact-position changing unit to change a sheet contact position at which the sheet feeding unit contacts the sheet, in the sheet conveying direction, wherein the sheet contact position is changed by the sheet-contact-position changing unit according to the alignment position corresponding to the first binding unit or the alignment position corresponding to the second binding unit.

2. The sheet processing apparatus according to claim 1, wherein a binding position of the sheets by the first binding unit and a binding position of the sheets by the second binding unit are set so as to be arrayed in the sheet conveying direction on the sheet stacking member.

3. The sheet processing apparatus according to claim 2, wherein the edge aligning unit is movable in the sheet conveying direction, and is configured to move the sheets aligned by the edge aligning unit up to the alignment position corresponding to the first binding unit or to the second binding unit.

4. An image forming system comprising:

an image forming device to form an image on a sheet; and the sheet processing apparatus of claim 2, to form at least binding processing on a bundle of sheets on which images are formed by the image forming device.

5. An image forming system comprising:

an image forming device to form an image on a sheet; and the sheet processing apparatus of claim 3, to form at least binding processing on a bundle of sheets on which images are formed by the image forming device.

6. The sheet processing apparatus according to claim 1, wherein the first binding unit or the second binding unit is selected based on the information on the sheets to perform the binding processing on the sheets.

7. An image forming system comprising:

an image forming device to form an image on a sheet; and the sheet processing apparatus of claim 6, to form at least binding processing on a bundle of sheets on which images are formed by the image forming device.

8. An image forming system comprising:

an image forming device to form an image on a sheet; and the sheet processing apparatus of claim 1, to form at least binding processing on a bundle of sheets on which images are formed by the image forming device.

9. The sheet processing apparatus according to claim 1, wherein the first binding unit and the second binding unit are integrally constructed.

10. The sheet processing apparatus according to claim 9, wherein a binding position of the sheets by the first binding unit and a binding position of the sheets by the second binding unit are set so as to be arrayed in the sheet conveying direction on the sheet stacking member.

11. An image forming system comprising:

an image forming device to form an image on a sheet; and the sheet processing apparatus of claim 9, to form at least binding processing on a bundle of sheets on which images are formed by the image forming device.

12. An image forming system comprising:

an image forming device to form an image on a sheet; and the sheet processing apparatus of claim 10, to form at least binding processing on a bundle of sheets on which images are formed by the image forming device.

13. The sheet processing apparatus according to claim 1, wherein the edge aligning unit is movable in the sheet conveying direction, and is configured to move the sheets aligned by the edge aligning unit up to an alignment position corresponding to the first binding unit or to the second binding unit.

14. An image forming system comprising:

an image forming device to form an image on a sheet; and the sheet processing apparatus of claim 13, to form at least binding processing on a bundle of sheets on which images are formed by the image forming device.

* * * * *